US006153869A

United States Patent [19]

Kim et al.

[11] Patent Number: 6,153,869

[45] Date of Patent: Nov. 28, 2000

[54] AC/DC TYPE MICROWAVE OVEN

[75] Inventors: Chul Kim, Anyang; Yong-woon Han, Kunpo; Seong-deog Jang, Suwon; Han-jun Sung, Seoul, all of Rep. of Korea

[73] Assignee: Samsung Electronics Co., Ltd., Suwon, Rep. of Korea

[21] Appl. No.: 09/226,213

[22] Filed: Jan. 7, 1999

[30] Foreign Application Priority Data

| | | | |
|---|---|---|---|
| Jul. 16, 1998 | [KR] | Rep. of Korea | 98-28849 |
| Jul. 16, 1998 | [KR] | Rep. of Korea | 98-28850 |
| Jul. 16, 1998 | [KR] | Rep. of Korea | 98-28851 |
| Jul. 16, 1998 | [KR] | Rep. of Korea | 98-28852 |

[51] Int. Cl.[7] ..... H05B 6/66

[52] U.S. Cl. ..... 219/715; 219/702; 363/15; 323/201

[58] Field of Search ..... 219/715, 716, 219/702; 363/15, 32; 323/201

[56] References Cited

U.S. PATENT DOCUMENTS

| | | | |
|---|---|---|---|
| 4,667,075 | 5/1987 | Sakurai | 219/715 |
| 4,900,885 | 2/1990 | Inumada | 219/716 |
| 4,904,837 | 2/1990 | Low et al. | 219/715 |
| 5,237,140 | 8/1993 | Akazawa et al. | 219/716 |
| 5,347,109 | 9/1994 | Nakabayashi et al. | 219/716 |

FOREIGN PATENT DOCUMENTS

| | | |
|---|---|---|
| 32-10728 | 5/1956 | Japan . |
| 54-36552 | 3/1979 | Japan . |
| 61-240588 | 10/1986 | Japan . |
| 2-306573 | 12/1990 | Japan . |
| 3-283382 | 12/1991 | Japan . |
| 6-76935 | 3/1994 | Japan . |
| 6-26197 | 4/1994 | Japan . |

*Primary Examiner*—Philip H. Leung
*Attorney, Agent, or Firm*—Burns, Doane, Swecker & Mathis, L.L.P.

[57] ABSTRACT

An AC/DC type microwave oven has a function of managing an input power source. The AC/DC type microwave oven comprises a rotatable inverter which inverts a DC power source to an AC power source by a rotational force, a high voltage transformer which receives a common power source or an AC power inverted by the rotatable inverter and outputs a higher voltage, a magnetron which is driven by the high voltage outputted from the high voltage transformer and radiates a microwave and a power control unit for sensing a signal from a power selecting key and preventing the AC and DC power sources from being simultaneously inputted. Therefore, both of AC power and DC power are prevented from being simultaneously supplied to the microwave oven which could result in a malfunction, or an overload occurs in the electric components of the microwave oven. Therefore, only one input power of the common and DC power sources is selected and, the microwave oven is operated properly. The remaining voltage of the battery is always detected and displayed through the display, thereby preventing a complete discharge of the battery.

9 Claims, 7 Drawing Sheets

AC/DC TYPE MICROWAVE OVEN

BACKGROUND OF THE INVENTION

1. Field of the Invention

The present invention relates to a microwave oven which can be used with AC/DC power sources, and more particularly to an AC/DC type microwave oven which has a function of managing an input power source.

2. Description of the Prior Art

Generally, a microwave oven is an apparatus for cooking food by using a microwave. The microwave oven is provided with a high voltage transformer and a magnetron. The high voltage transformer serves to step up a common voltage of about 220V/110V to a high voltage of about 2,000V~4,000V. The magnetron is driven by the high voltage and radiates microwaves of a desired frequency. The microwaves vibrate molecules of moisture contained within the food. Therefore, the food is cooked by the frictional heat generated by the vibration of the moisture molecules. Here, the high voltage transformer receives an AC voltage via an input part thereof, and steps up or down the AC input voltage proportional to a turn ratio of a primary winding and a secondary winding thereof. The AC voltage which is stepped up or down is fed to an output part of the transformer. Typically, the conventional microwave oven described above is designed to be driven by an AC power source.

FIG. 1 is a circuit diagram showing the conventional microwave oven using the AC power source. In FIG. 1, a reference numeral 10 denotes a high voltage transformer, 11 is a primary coil, 12 is a first secondary coil, and 13 is a second secondary coil.

The primary coil 11 is wound on the input part of the high voltage transformer 10. The first and second secondary coil 12, 13 are wound on the output part of the high voltage transformer 10. The primary coil 11 is connected with an AC power source AC. SW1 is a power switch. The power switch SW1 is located on a connecting wire which is disposed between the primary coil 11 and the AC power source AC, and connects or disconnects the primary coil 11 with the AC power source AC. A high voltage condenser HVC, a high voltage diode HVD and a magnetron MGT are connected to the output part of the transformer 10. The first secondary coil 12 pre-heats the magnetron MGT, and the second secondary coil 13 steps up the voltage provided by the AC power source to a voltage of about 2,000V. The second secondary coil 13 is connected with the magnetron via the high voltage condenser HVC and the high voltage diode HVD. The high voltage condenser HVC and the high voltage diode HVD are a voltage doubler to further step up the voltage raised by the second secondary coil 13 to a voltage of about 4,000V. The magnetron MGT is driven by the voltage of 4,000V and radiates a microwave of 2,450 MHz.

The operation of the conventional microwave oven constructed as above will be described as follows: If a user turns on the power switch SW1, the AC voltage is supplied to the high voltage transformer 10 via the power switch SW1. In the high voltage transformer 10, the AC input voltage is fed to the primary coil 11 of the input part and then induced to the first and second secondary coils 12 and 13 of the output part. The first secondary coil 12 pre-heats the magnetron MGT, and the second secondary coil 13 steps up the AC input voltage fed to the input part of the primary coil 11 to about 2,000V. The AC output voltage of about 2,000V, which is raised by the second secondary coil 13, is doubled by the high voltage condenser HVC and the high voltage diode HVD, and is then applied to the magnetron MGT.

Therefore, the magnetron MGT is driven by the AC output voltage of about 4,000V and radiates a microwave of 2,450 MHz. The food within a cooking chamber (not shown) is cooked by the microwaves radiated by the magnetron MGT.

However, since the conventional microwave oven is designed to be driven by the common power source of AC 220V/110V, there is a problem that the conventional microwave oven can not be used in the open-air or in a ship, an aircraft or any other vehicles.

To overcome the above problem, there is proposed another conventional microwave oven that, when using the microwave oven in a place where an AC power source is not available, an inverter employing a separate semiconductor device may be connected with the microwave oven so as to invert a DC power source into an AC power source, or the inverter is disposed in the microwave oven itself.

FIG. 2 is a circuit diagram of a conventional microwave oven, and FIG. 3 is a circuit diagram of the inverter employing a semiconductor device. In FIG. 2, the construction of the part of the AC power source is the same as FIG. 1, and in the part of the DC power source, there are disposed the inverter 20 employing a semiconductor device and a power switch SW2. The inverter employing a semiconductor device inverts the DC power source into the AC power source, and drives a high voltage transformer 10. A first primary coil 11 and a second primary coil 14 are wound on an input part of the high voltage transformer 10. The first primary coil 11 receives the AC power source, and the second primary coil 14 receives the AC power source inverted by the inverter 20. Further, a first secondary coil 12 and a second secondary coil 13 are wound on an output part of the high voltage transformer 10 along with a high voltage condenser HVC, a high voltage diode HVD and a magnetron MGT.

As shown in FIG. 3, the inverter 20 employing the semiconductor device comprises a trigger circuit 1, a plurality of thyristors th1 and th2 and a condenser C1. The plurality of thyristors th1 and th2 are switched on or off by a switching operation of the trigger circuit 1, and a current in the second primary coil 14 of the high voltage transformer 10 is thus outputted in turn, thereby generating the AC power source having a desired voltage in the high voltage transformer 10.

However, in this type of AC/DC microwave oven provided with the inverter employing the semiconductor device, there is a problem. That is, since it is necessary to provide a plurality of expensive semiconductor devices for the inverter in order to output a desired high voltage for the magnetron, the manufacturing cost is increased.

In the above conventional AC/DC microwave oven, there is another problem that the life span of the battery which supplies the DC power source is short, since the attrition rate of the current by the semiconductor device is very high.

In the above conventional AC/DC microwave oven, there is another problem that, since the semiconductor device generates excessive heat, energy loss by the heat is increased.

In the above conventional AC/DC microwave oven, there is a further problem that, since the size of the cooling fins is increased to cool the semiconductor device, the size of the microwave oven has to be increased.

In order to overcome the above problems, the applicant of the present invention has developed an improved AC/DC type microwave oven and disclosed it in the Korean Patent Application No. 98-18588 filed on May 22, 1998. In this improved AC/DC type microwave, the manufacturing cost is lowered, the attrition rate of the current is lowered, the energy loss by the heat is decreased, the size of the microwave oven can be small, and the output frequency from the rotatable inverter can be controlled to be kept constant whereby the microwaves are also stably radiated. After this, while the applicant has continuously improved the AC/DC type microwave, it is found that some new technical requirements are necessary to be more convenient for use of the microwave oven, as follows;

First, in the above disclosed AC/DC microwave oven, if power switches for the AC and DC power source are simultaneously switched on by mistake, it is apprehended that both of AC power and DC power are supplied to the microwave oven and the microwave oven is not operated properly, or an overload is applied to the electric parts of the microwave oven. Therefore, it is necessary to prevent the AC and DC power sources from being simultaneously inputted to the microwave oven.

Secondly, in case that a battery is used as the DC power source for the above disclosed AC/DC microwave oven, it is apprehended that operation of the microwave oven will be interrupted by the discharge of the battery, while a user does not realize it. Therefore, it is necessary to detect the voltage of the battery and display it.

SUMMARY OF THE INVENTION

The present invention has been made to overcome above problems, and accordingly, it is an object of the present invention to provide an AC/DC type microwave oven which has a function of managing the input power source to prevent the AC and DC power sources from being simultaneously inputted to the microwave oven.

Another object of the present invention is to provide an AC/DC type microwave oven which has the function of managing the input power source to select only one of several power sources.

Yet Another object of the present invention is to provide an AC/DC type microwave oven which has the function of managing the input power source to detect the voltage of the battery and display it.

The above object is accomplished by the AC/DC type microwave oven which has the function of managing the input power source according to the present invention comprising a rotatable inverter which inverts a DC power source to an AC power source by means of a rotational force, a high voltage transformer which receives a common power source or an AC power inverted by the rotatable inverter and outputs a higher voltage, a magnetron which is driven by the high voltage outputted from the high voltage transformer and radiates a microwave; and a power control unit for sensing a signal from an power selecting key and preventing the AC and DC power sources from being simultaneously inputted. The power control unit comprises a first power selecting key for selecting a common power source (AC), a second power selecting key for selecting a DC power source, a first power relay for connecting or disconnecting the common power source with the high voltage transformer, a second power relay for connecting or disconnecting the DC power source with the rotatable inverter, and a micro-computer for selectively switching on/off the first power relay or the second power relay corresponding to the input signal from the first power selecting key or the second power selecting key. The micro-computer prevents the operation of the first power relay and the second power relay, when the signals from both of the first power selecting key and the second power selecting key are inputted to the micro-computer.

The rotatable inverter comprises a motor generating the rotational force, a commutator driven by the motor and a plurality of brushes which are respectively contacted with an outer surface of the commutator. The commutator comprises a cylindrical body made of an insulating material, and conductive parts which are divided into an even-number by non-conductive parts respectively having a desired width, whereby two brushes which are adjacent to each other are simultaneously contacted with one side of the conductive parts. Each of the non-conductive parts has a width which is wider than an end of the brush or which is the same as the end of the brush. The second power relay connects or disconnects the DC power source with the motor and brushes. One pair of brushes which are opposite each other are connected through the second power relay to the DC power source, and the other pair of brushes which are opposite each other are connected to the high voltage transformer. The motor is connected in parallel with the pair of brushes which are connected through the second power relay to the DC power source. The second power relay is connected in parallel with a condenser. Between the respective brushes, which are adjacent to each other, is respectively connected diodes for preventing a backward voltage flow.

Another object of the present invention is accomplished by the AC/DC microwave oven according to the present invention which has the function of managing the input power source, comprising a rotatable inverter which inverts a DC power source to an AC power source by means of a rotational force, a high voltage transformer which receives a common power source or an AC power inverted by the rotatable inverter and outputs a higher voltage, a magnetron which is driven by the high voltage outputted from the high voltage transformer and radiates a microwave and a power control unit for detecting the common power source and the DC power source and selecting only one power source. The power control unit comprises a starting key for driving the microwave oven, a first power sensing means for sensing the common power source, a second power sensing means for sensing the DC power source, a first power relay for connecting or disconnecting the common power source with the high voltage transformer, a second power relay for connecting or disconnecting the DC power source with the rotatable inverter, and a micro-computer. If the first power sensing means senses the common power source and a signal from the starting key is inputted to the micro-computer, the micro-computer switches on the first power relay, and if the second power sensing means senses the DC power source and the signal from the starting key is inputted to the micro-computer, the micro-computer switches on the second power relay. Further, if both of the first and second power sensing means sense, respectively, the common and DC power sources and the signal from the starting key is inputted to the micro-computer, the micro-computer switches on only the first power relay, whereby the microwave oven is driven by the common power source.

Yet another object of the present invention is accomplished by the AC/DC microwave oven which has the function of managing the input power source according to the present invention, comprising a rotatable inverter which inverts a DC power source to an AC power source by means of a rotational force, a high voltage transformer which receives a common power source or an AC power inverted by the rotatable inverter and outputs a higher voltage, a magnetron which is driven by the high voltage outputted from the high voltage transformer and radiates a microwave and a switch which is switched by a user so as to select only one power source of the common and DC power sources. If the switch is switched to the side of the common power source, the side of the DC power source is switched off, and if the switch is switched to the side of the DC power source, the side of the common power source is switched off.

Yet another object of the present invention is accomplished by the AC/DC microwave oven which has the function of managing the input power source according to the present invention, comprising a rotatable inverter which inverts a DC power source to an AC power source by means of a rotational force, a high voltage transformer which receives a common power source or an AC power inverted by the rotatable inverter and outputs a higher voltage, a magnetron which is driven by the high voltage outputted from the high voltage transformer and radiates a microwave and a power control unit for detecting a voltage of the DC power source and displaying it. The power control unit comprises a voltage detecting means for sensing the DC power source and detecting a value of the voltage of the DC power source, a micro-computer for displaying the value detected by the voltage detecting means through the display means. If the value detected by voltage detecting means is lower than a reference value, the operation of the microwave oven is stopped by the micro-computer.

Therefore, according to the present invention, both of AC power and DC power are prevented from being simultaneously supplied to the microwave oven which result in a malfunction, or an overload condition occurs in the electric components of the microwave oven. Since only one input power of the common and DC power sources is selected, the microwave oven is operates properly. The remaining voltage of the battery is always detected and displayed through the displaying means, thereby preventing complete discharge of the battery.

BRIEF DESCRIPTION OF THE DRAWINGS

The above objects and advantages will be more apparent by describing the present invention with reference to the accompanied reference drawing, in which.

DETAILED DESCRIPTION OF THE PREFERRED EMBODIMENT

Figure 1:
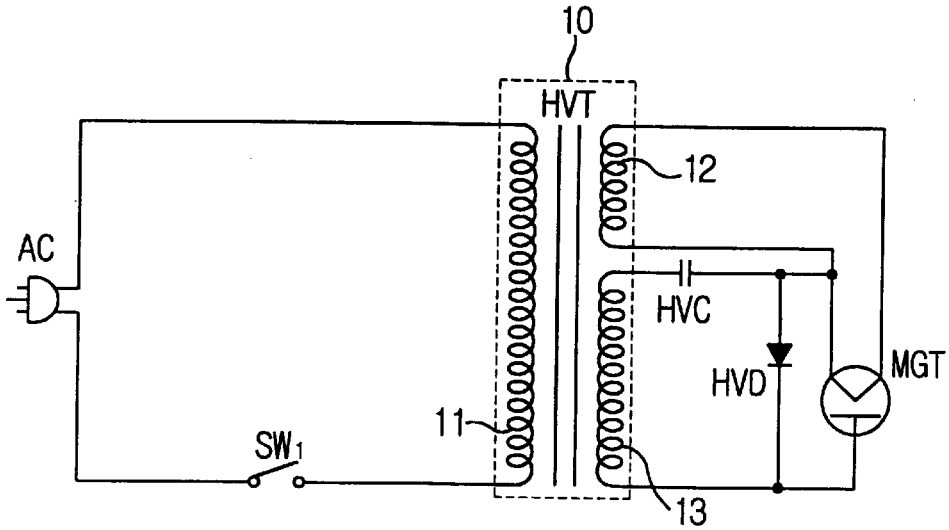
FIG. 1 (PRIOR ART)
FIG. 1 is a circuit diagram of a conventional AC type microwave oven.
Figure 2:
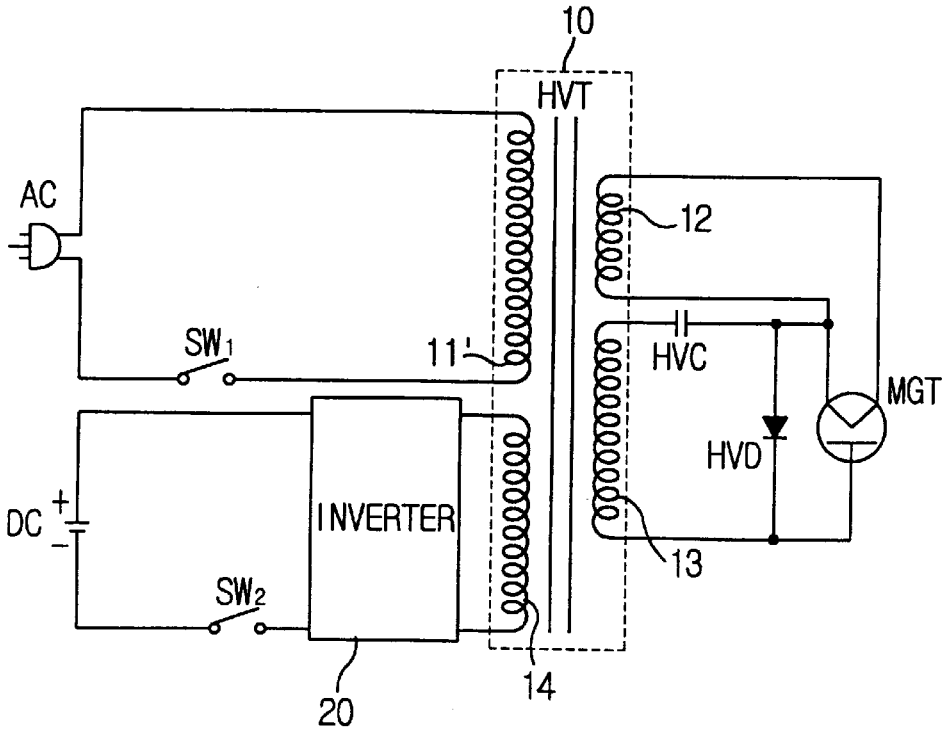
FIG. 2 (PRIOR ART)
FIG. 2 is a circuit diagram of another conventional AC/DC type microwave oven.
Figure 3:
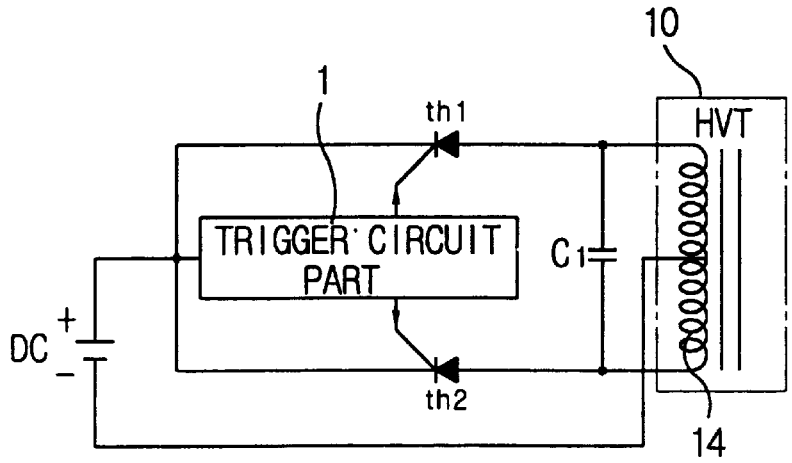
FIG. 3 (PRIOR ART)
FIG. 3 is a circuit diagram of the inverter used in the AC/DC type microwave oven of FIG. 2.
Figure 4:
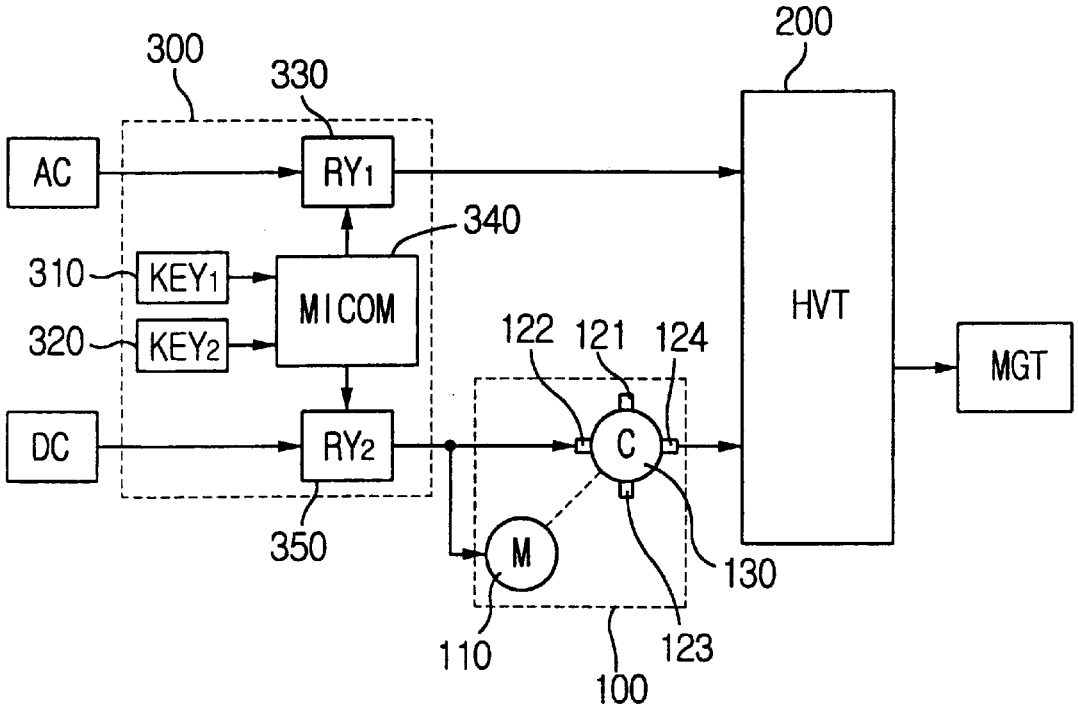
FIG. 4 is a block diagram of an AC/DC type microwave oven which has a function of managing an input power source according to the first preferred embodiment of the present invention.
Figure 5:
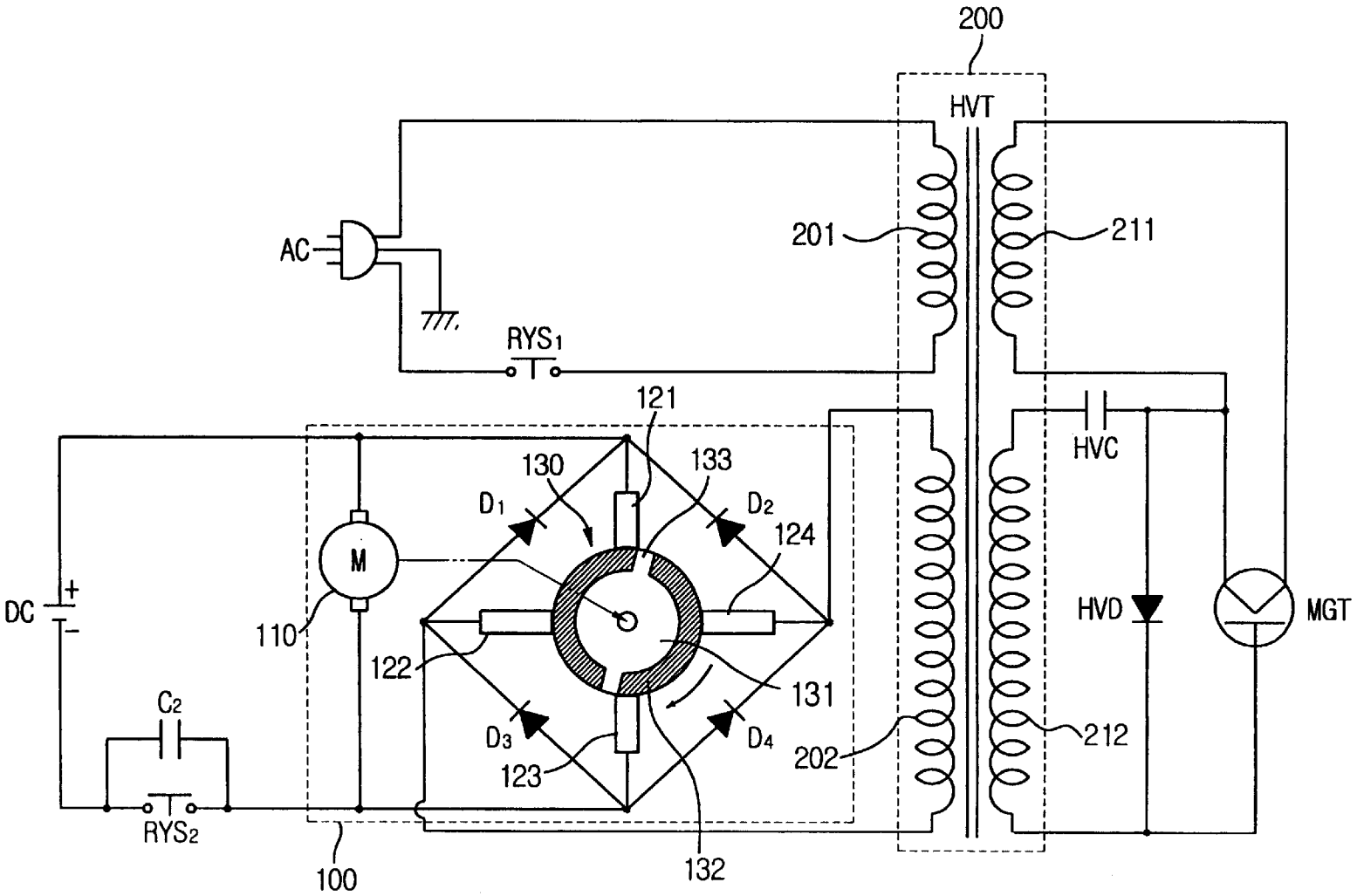
FIG. 5 is a circuit diagram of the main part of the AC/DC type microwave in FIG. 4.

FIG. 4 is a block diagram of an AC/DC type microwave oven which has a function of managing an input power source according to the first preferred embodiment of the present invention, FIG. 5 is a circuit diagram of a main part of the AC/DC type microwave in FIG. 4.

In FIG. 4, a reference numeral 100 denotes a rotatable inverter, 110 is a motor, 121 to 124 are brushes, 130 is a commutator, 200 is a high voltage transformer, 300 is a power control unit and MGT is a magnetron. The rotatable inverter 100 comprises the commutator 130, the brushes 121, 122, 123, 124, and the motor 110. Each of the brushes 121, 122, 123, 124 is contacted with the outer surface of the commutator 200. The commutator 200 is rotated by the motor 110. The rotatable inverter 100 inverts a DC power source into an AC power source by the rotation of the commutator 130. The high voltage transformer 200 receives a common power source or the AC power source inverted by the rotatable inverter 100 and outputs a desired high voltage. The magnetron MGT is driven by the high voltage outputted from the high voltage transformer 200 and radiates a microwave. The power control unit 300 senses a signal from a power selecting key and prevents the AC and DC power sources from being simultaneously inputted to the microwave oven. The power control unit 300 comprises a first power selecting key 310 for selecting a common power source (AC), a second power selecting key 320 for selecting a DC power source, a first power relay 330 for connecting or disconnecting the common power source with the high voltage transformer 200, a second power relay 350 for connecting or disconnecting the DC power source with the rotatable inverter 100 and a micro-computer 340 for selectively switching on/off the first power relay 330 or the second power relay 350 corresponding to the input signal from the first power selecting key 310 or the second power selecting key 320. Here, if the signals from both of the first power selecting key 310 and the second power selecting key 320 are inputted, the micro-computer 340 prevents the operations of the first power relay 330 and the second power relay 350.

In FIG. 5, the high voltage transformer 200 comprises a first primary coil 201, a second primary coil 202, a first secondary coil 211 and a second secondary coil 212. Here, the first and second primary coils 201 and 202 are wound on the input part, and the first and second secondary coils 211 and 212 are wound on the output part. The common AC power source is inputted to the first primary coil 201, and the AC power inverted by the rotatable inverter 100 is inputted to the second primary coil 202. The common AC power source is fed through a contact RYS1 of the first power relay 330 to the first primary coil 201 of the high voltage transformer 200. The DC power source is supplied through a contact RYS2 of the second power relay 350 to the rotatable inverter 100. The rotatable inverter 100 comprises the commutator 130, the brushes 121, 122, 123, 124, and the motor 110. Each of the brushes 121, 122, 123, 124 is contacted with the outer face of the commutator 130. The commutator 130 is rotated by the motor 110. Here, one pair of brushes 121 and 123 which are opposite each other are connected to the DC power source, and the other pair of brushes 122 and 124 which are opposite each other are connected to the second primary coil 202 of the high voltage transformer 200. Each of diodes for preventing a backward voltage flow D1, D2, D3, D4 are, respectively, connected between the respective brushes 121, 122, 123, 124, which are adjacent to each other. The motor 110 is connected to the DC power source in parallel with the pair of brushes 121, 123. Therefore, when the contact RYS2 of the second power relay 350 is switched on, the DC power source is supplied to the brushes 121 and 123 and the motor 110. A condenser C2 is connected in parallel with the contact RYS2 of the second power relay 350. The commutator 130 comprises a cylindrical body 131 and conductive parts 132 which are formed on the outer surface of the cylindrical body 131. The conductive parts 132 are, respectively, divided into an even-number by non-conductive parts 133 having a predetermined width, and respectively connected with the two brushes which are adjacent to each other. Meanwhile, it is preferable that each of the non-conductive parts has a width which is wider than an end of the brush or which is the same as the end of the brush. The high voltage condenser HVC, the high voltage diode HVD and the magnetron MGT are connected to the first secondary coil 211 and second secondary coil 212 of the high voltage transformer 200. The construction and operation thereof are the same as that of the prior art, and a detailed explanation thereof is thus omitted.

Figure 6:
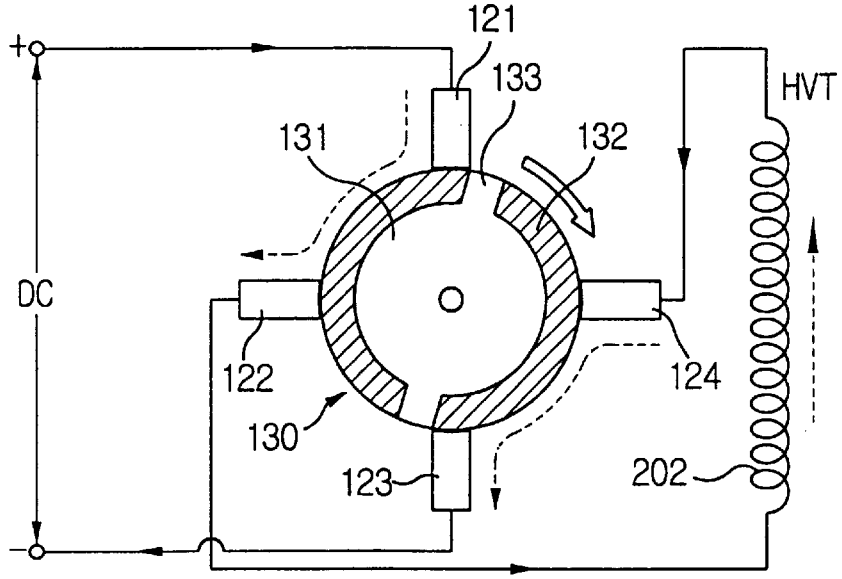
FIGS. 6 and 7 are views showing the operations of how the DC current is inverted into AC current according to the present invention.
Figure 7:
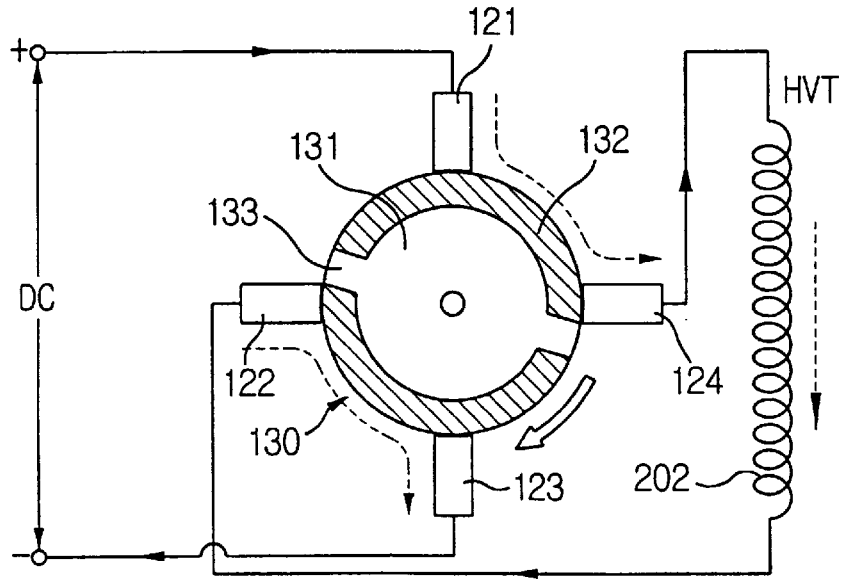

FIGS. 6 and 7 are views showing the operations of how the DC current is inverted into AC current according to the present invention.

As shown in FIG. 6, a current is inputted from a positive terminal of the DC power source to the upper brush 121, and flows through the conductive part 132 of the commutator 132 and the left brush 122 from a lower portion of the second primary coil 202 toward an upper portion of the second primary coil 202. Further, the current is inputted to the right brush 124 and circulated through the conductive part 132 and the lower brush 123 to a negative terminal of the DC power source.

In FIG. 7, the current is inputted from the positive terminal of the DC power source to the upper brush 121 and flows through the conductive part 132 of the commutator 130 and the right brush 124 from the upper portion of the second primary coil 202 toward the lower portion of the second primary coil 202, while the commutator 130 is rotated at a desired angle, for example at 90 degrees. Further, the current is inputted to the left brush 122 and circulated through the conductive part 132 and the lower brush 123 to a negative terminal of the DC power source.

The operation of AC/DC type microwave oven which has a function of managing an input power source as constructed above, according to a first embodiment of the present invention, will be explained in detail accompanying with FIGS. 4 to 9.

In the operation by the DC power source, when the second power selecting key 320 is switched on by a user, the micro-computer 340 sense the signal from the second power selecting key 320 and switches on the contact RYS2 of the second power relay 350. Thus, the DC power source of 12V or 24V from the battery BATT is supplied through the contact RYS2 of the second power relay 350 to the motor 110 and the upper brush 121. The condenser C2 which is connected in parallel with the contact RYS2 of the second power relay 350 charges or discharges a voltage so that the motor 110 can be smoothly rotated at an initial operation. The commutator 130 is rotated by the motor 110. Therefore, the conductive parts 132 are contacted with the respective brushes 121, 122, 123, 124 in turn, whereby the DC power source is inverted to the AC power source. That is, the current of the DC power source supplied from the positive terminal of the battery BATT is inputted through the upper brush 121 in FIG. 6 to the commutator 130. The current thus flows through the conductive part 132 toward the left brush 122, and is inputted from the lower portion of the second primary coil 202 of the high voltage transformer 200 to the upper portion thereof And then, the current is circulated through the right brush 124, the conductive part 132 and the lower brush 123 to the negative terminal of the battery BATT. The DC power source supplied from the positive terminal of the battery BATT is inputted through the upper brush 121, the conductive part 132 and the right brush 124 from the upper portion of the second primary coil 202 toward the lower portion thereof, while the commutator 130 is rotated at a desired angle, for example, at 90 degrees as shown in FIG. 7. After that, the current is circulated through the left brush 122, the conductive part 132 and the lower brush 123 to a negative terminal of the battery. Therefore, in every one rotation (360 degrees) of the commutator 130 by the motor 110, the current direction in the second primary coil 202 of the high voltage transformer 200 is changed twice to up and down in turns, thereby generating the AC power of a desired frequency. The transformer 200 induces the AC power supplied to the second primary coil 202 into the first and second secondary coils 211 and 212. The first secondary coil 211 pre-heats the magnetron MGT, and the second secondary coil 212 steps up the power inputted to the second primary coil 202 to about 2,000V proportional to a turn ratio. The raised power is further stepped up through the high voltage condenser HVC and high voltage diode HVD to about 4,000V and then is supplied to the magnetron MGT. Therefore, the microwaves of 2,450 MHz are generated from the magnetron, and the food in the cooking chamber (not shown) is cooked by the microwaves.

In the operation by the common power source of 220V/110V, when the first power selecting key 310 is switched on by a user, the micro-computer 340 senses the signal from the first power selecting key 310 and switches on the contact RYS1 of the first power relay 330. Thus, the common power source from a power code is supplied through the contact RYS1 of the first power relay 330 to the high voltage transformer 200. The transformer 200 induces the common power supplied to the first primary coil 201 into the first and second secondary coils 211 and 212. The first secondary coil 211 pre-heats the magnetron MGT, and the second secondary coil 212 steps up the power inputted to the first primary coil 201 to about 2,000V proportional to a turn ratio. The raised power is further stepped up through the high voltage condenser HVC and high voltage diode HVD to about 4,000V and then supplied to the magnetron MGT. Therefore, the microwaves of 2,450 MHz are generated from the magnetron, and the food in the cooking chamber (not shown) is cooked by the microwaves. Meanwhile, if the first and second power switches 310 and 320 are simultaneously switched on by mistake, the micro-computer 340 senses the signals from the first and second power switches 310 and 320 and prevents the operations of the first power relay 330 and the second power relay 350, whereby preventing the AC and DC power sources from being simultaneously inputted to the microwave oven.

Figure 8:
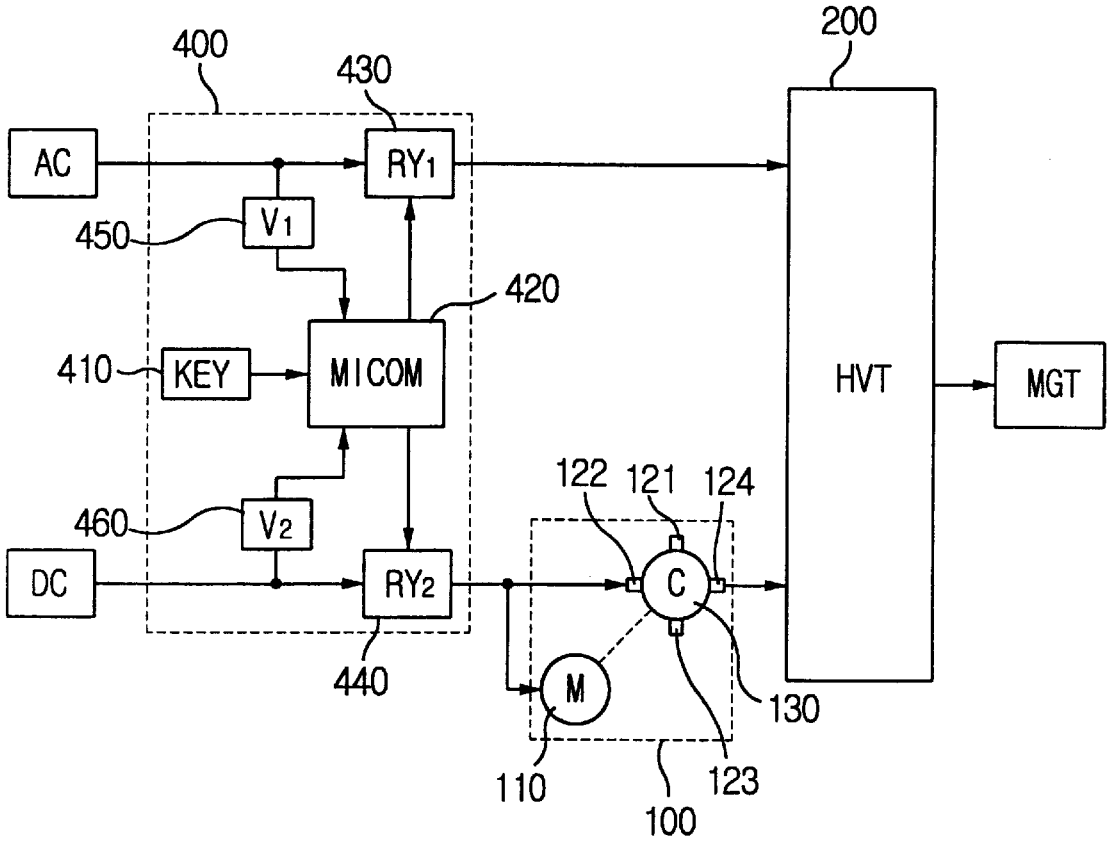
FIG. 8 is a block diagram showing the second preferred embodiment of the present invention.

FIG. 8 is a block diagram showing the second preferred embodiment of the present invention. In FIG. 8, the construction and operation of the motor 110, the rotatable inverter 100, the high voltage transformer 200, the magnetron MGT are the same as the first embodiment of the present invention. Here, the rotatable inverter 100 is provided with the brushes 121, 122, 123, 124 and the commutator 130. The transformer 200 has the first and second primary coil 201, 202 and first and second secondary coil 211, 212. However, the microwave oven according to the second preferred embodiment of the present invention further comprises a power control unit 400 for detecting the common power source and the DC power source and selecting only one power source. The power control unit 400 comprises a starting key 410, a first power sensing means 450, a second power sensing means 460, a first power relay 430, a second power relay 440 and a micro-computer 420. The starting key 410 drives the microwave oven. The first power sensing means 450 senses the common power source, the second power sensing means 460 senses the DC power source. The first power relay 430 connects or disconnects the common power source with the high voltage transformer 200, and the second power relay 440 connects or disconnects the DC power source with the rotatable inverter 100. If the first power sensing means 450 senses the common power source and a signal from the starting key 410 is inputted to the micro-computer 420, the micro-computer 420 switches on the first power relay 430. If the second power sensing means 460 senses the DC power source and the signal from the starting key 410 is inputted to the micro-computer 420, the micro-computer 420 switches on the second power relay 440. Further, if both the first and second power sensing means 450 and 460 sense, respectively, the common and DC power sources, and the signal from the starting key 410 is inputted to the micro-computer 420, the micro-computer 420 switches on only the first power relay 430, whereby the microwave oven is driven by the common power source. Therefore, the micro-computer 420 detects the common and DC power sources with the first and second power sensing means 450 and 460, and controls the first and second power relays 430 and 440 so as to prevent the common and DC power sources from being simultaneously inputted to the high voltage transformer 200.

Figure 9:
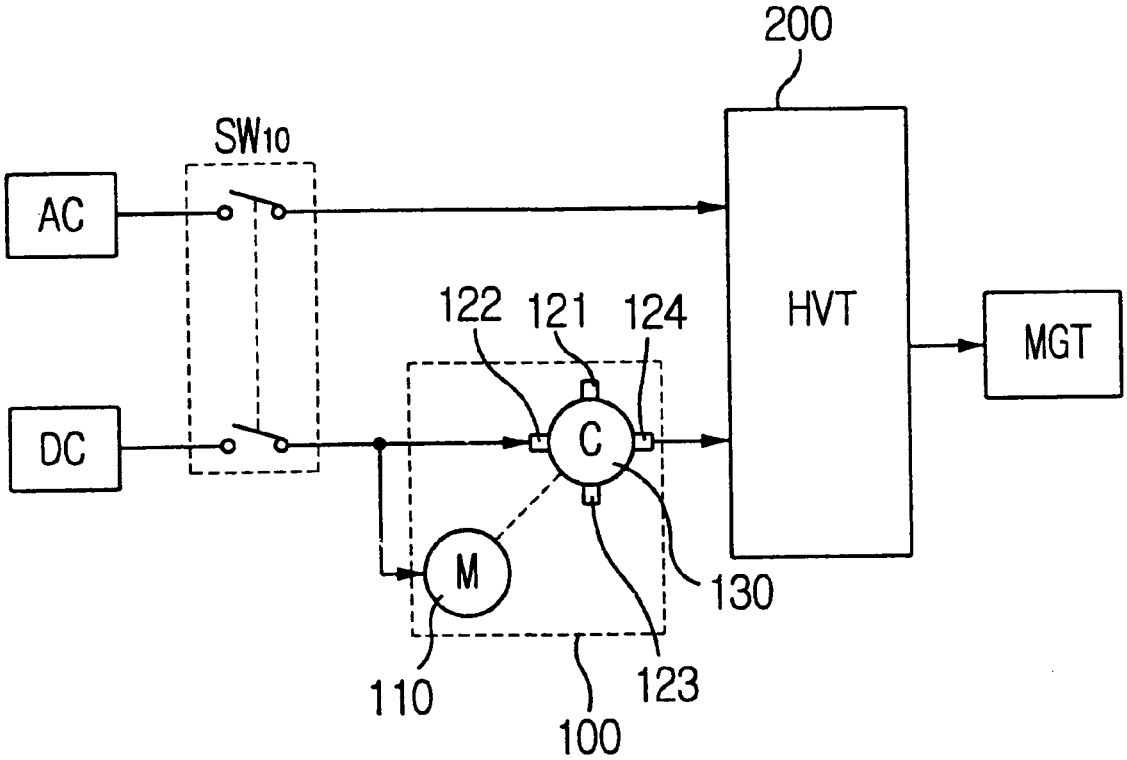
FIG. 9 is a block diagram showing the third preferred embodiment of the present invention.

FIG. 9 is a block diagram showing the third preferred embodiment of the present invention. In FIG. 9, the construction and operation of the motor 110, the rotatable inverter 100, the high voltage transformer 200, the magnetron MGT are the same as the first embodiment of the present invention as shown in FIG. 4. However, the microwave oven according to the third preferred embodiment of the present invention further comprises a switch SW10. The switch SW10 is switched by a user, thereby selecting only one power source of the common and DC power sources. That is, if the switch SW10 is switched to the side of the common power source, the side of the DC power source is switched off. If the switch SW10 is switched to the side of the DC power source, the side of the common power source is switched off, thereby preventing the common and DC power sources from being simultaneously inputted to the high voltage transformer 200.

Figure 10:
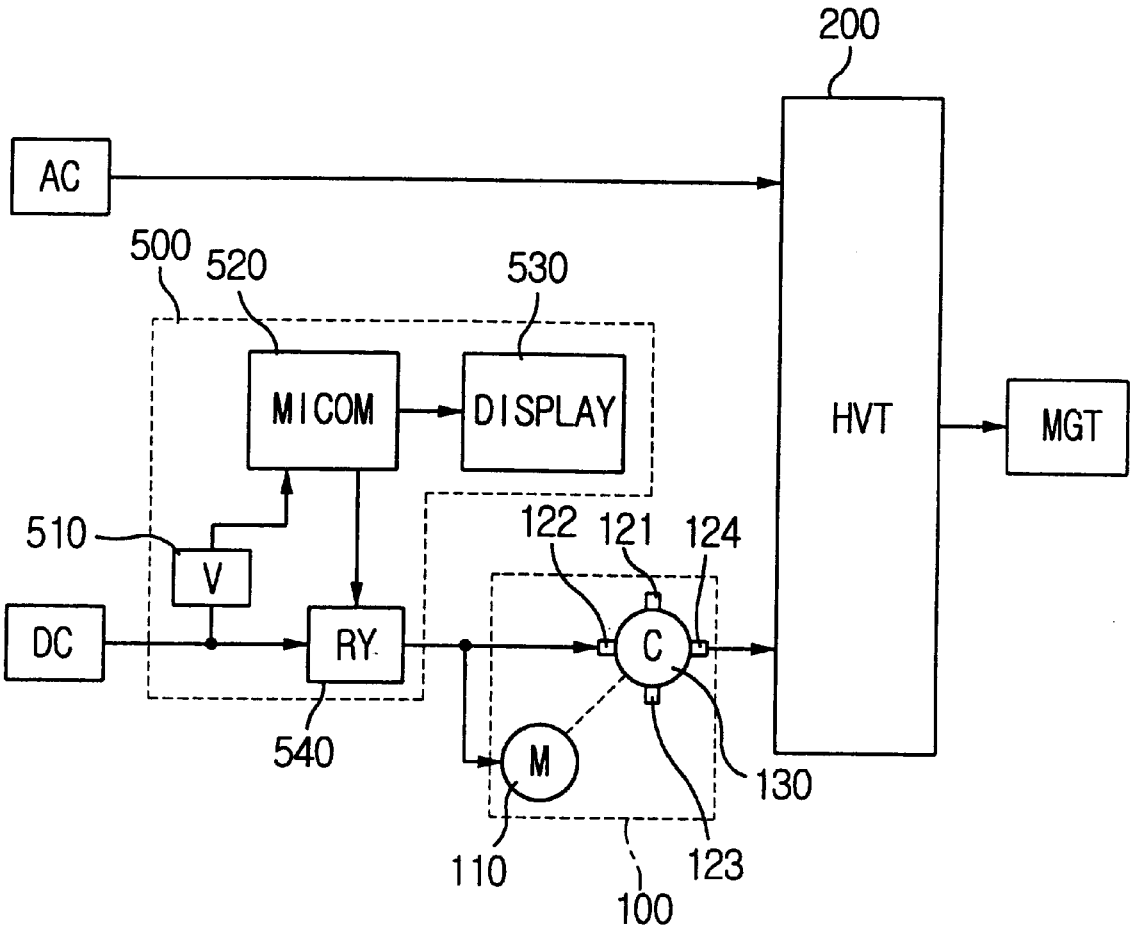
FIG. 10 is a block diagram showing the fourth preferred embodiment of the present invention.

FIG. 10 is a block diagram showing the fourth preferred embodiment of the present invention. In FIG. 10, the construction and operation of the motor 110, the rotatable inverter 100, the high voltage transformer 200, the magnetron MGT are the same as the first embodiment of the present invention as shown in FIG. 4. However, the microwave oven according to the fourth preferred embodiment of the present invention further comprises a power control unit 500 for detecting a voltage of the DC power source and displaying it. The power control unit 500 comprises a voltage detecting means 510, a micro-computer 520, a displaying means 530 and a power relay 540. The voltage detecting means 510 senses the DC power source and then detects the value of the voltage of the DC power source. The micro-computer 520 displays the value detected by voltage detecting means 510 through the display means 530. Further, if the value detected by voltage detecting means 510 is lower than the reference value, the power relay 540 is switched off by the micro-computer 520 so that the operation of the microwave oven is stopped. Therefore, the user may realize the remaining voltage of the battery, thereby preventing complete discharge of the battery.

According to the AC/DC microwave oven of the present invention, both of AC power and DC power are prevented from being simultaneously supplied to the microwave oven which results in a malfunction, or an overload occurs in the electric components of the microwave oven.

Further, according to the AC/DC microwave oven of the present invention, only one input power of the common and DC power sources is selected, the microwave oven is operated effectively.

Further, according to the AC/DC microwave oven of the present invention, the remaining voltage of the battery is always detected and displayed through the displaying means, thereby preventing a complete discharge of the battery.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. An AC/DC type microwave oven comprising:

a rotatable inverter which inverts a DC power source to an AC power source by means of a rotational force;

a high voltage transformer which receives a common power source or an AC power inverted by the rotatable inverter and outputs a higher voltage;

a magnetron which is driven by the high voltage outputted from the high voltage transformer and radiates a microwave; and a power control unit for sensing a signal from a power selecting key and preventing the AC and DC power sources from being simultaneously inputted, wherein the rotatable inverter comprises a motor generating the rotational force, a commutator driven by the motor and a plurality of brushes which are, respectively, contacted with the outer surface of the commutator, and the commutator comprises a cylindrical body made of an insulating material, and conductive parts which are divided into an even-number by non-conductive parts, respectively having a desired width, whereby the two brushes which are adjacent to each other are simultaneously contacted with one side of the conductive parts.

2. An AC/DC microwave oven as claimed in claim 1, wherein the power control unit comprises a first power selecting key for selecting a common power source (AC); a second power selecting key for selecting a DC power source; a first power relay for connecting or disconnecting the common power source with the high voltage transformer; a second power relay for connecting or disconnecting the DC power source with the rotatable inverter; and a micro-computer for selectively switching on/off the first power relay or the second power relay corresponding to the input signal from the first power selecting key or the second power selecting key.

3. An AC/DC microwave oven as claimed in claim 2, wherein the micro-computer prevents the operation of the first power relay and the second power relay, when the signals from both of the first power selecting key and the second power selecting key are inputted to the micro-computer.

4. An AC/DC microwave oven as claimed in claim 2, wherein the second power relay connects or disconnects the DC power source with the motor and brushes.

5. An AC/DC microwave oven as claimed in claim 4, wherein one pair of brushes which are opposite each other are connected through the second power relay to the DC power source, and the other pair of brushes which are opposite each other are connected to the high voltage transformer.

6. An AC/DC microwave oven as claimed in claim 5, wherein the motor is connected in parallel with the pair of brushes which are connected through the second power relay to the DC power source.

7. An AC/DC microwave oven as claimed in claim 4, wherein the second power relay is connected in parallel with a condenser.

8. An AC/DC microwave oven as claimed in claim 1, wherein each of the nonconductive parts has a width which is wider than an end of the brush or which is the same as the end of the brush.

9. An AC/DC microwave oven as claimed in claim 1, wherein between the respective brushes, which are adjacent to each other, are respectively connected with diodes for preventing a backward voltage flow.

* * * * *